US006234716B1

(12) United States Patent
Chiaves

(10) Patent No.: US 6,234,716 B1
(45) Date of Patent: May 22, 2001

(54) UNDERGROUND STRUCTURAL WORK INCLUDING PREFABRICATED ELEMENTS ASSOCIATED WITH PILES AND A PROCESS FOR ITS PRODUCTION

(76) Inventor: Carlo Chiaves, Corso Govone 10, I-10129 Turin (IT)

( * ) Notice: Subject to any disclaimer, the term of this patent is extended or adjusted under 35 U.S.C. 154(b) by 0 days.

(21) Appl. No.: 09/068,505

(22) PCT Filed: Nov. 14, 1996

(86) PCT No.: PCT/EP96/04988

§ 371 Date: May 12, 1998

§ 102(e) Date: May 12, 1998

(87) PCT Pub. No.: WO97/19230

PCT Pub. Date: May 29, 1997

(30) Foreign Application Priority Data

Nov. 17, 1995 (IT) ..... T095A0923

(51) Int. Cl.[7] ..... E02D 29/045

(52) U.S. Cl. ..... 405/149; 405/239; 14/26; 52/87

(58) Field of Search ..... 405/124–126, 405/149, 239, 232, 258, 267, 134; 404/71, 43; 14/77.1, 26; 52/87, 169.9, 259, 741.15

(56) References Cited

U.S. PATENT DOCUMENTS

| | | | | |
|---|---|---|---|---|
| 1,746,566 | * | 2/1930 | Tufts | 405/149 |
| 2,194,279 | * | 3/1940 | Goldsborough | 405/149 |
| 2,512,831 | * | 6/1950 | Holmes | 405/239 X |
| 2,789,419 | * | 4/1957 | Pickman | 405/239 X |
| 3,555,979 | * | 1/1971 | Veder | 405/149 X |
| 4,073,148 | * | 2/1978 | Zaretti | 405/149 X |
| 4,693,634 | * | 9/1987 | Chiaves | 405/124 X |
| 5,207,038 | * | 5/1993 | Negri | 405/149 X |

FOREIGN PATENT DOCUMENTS

| | | | | |
|---|---|---|---|---|
| 893573 | | 10/1982 | (BE) . | |
| 262879 | | 8/1909 | (DE) . | |
| 4302986 | | 8/1994 | (DE) . | |
| 0197021 | * | 10/1986 | (EP) | 405/149 |
| 0277399 | | 8/1988 | (EP) . | |
| 0296013 | | 12/1988 | (EP) . | |
| 7117176 | | 6/1972 | (NL) . | |

* cited by examiner

*Primary Examiner*—William Neuder
*Assistant Examiner*—Sunil Singh
(74) *Attorney, Agent, or Firm*—Sughrue, Mion, Zinn, Macpeak & Seas, PLLC

(57) ABSTRACT

An underground structural work, particularly for forming tunnels, underpasses, carparks or the like, includes a pair of containment structures which extend along two opposite sides of the work. These structures include pile elements capable of carrying a deck of the work formed by substantially vaulted deck sections which extend transversely of the containment structure. In at least some of the pile elements there is incorporated a prefabricated supporting element which includes an elongate reinforcement and a concrete body anchored to the reinforcement. Each deck section includes prefabricated elements of concrete defining a pair of side portions and a central portion which can be interposed between them. Between the lateral portions and the concrete bodies are formed free spaced to allow casting in situ of concrete for mutual anchoring.

12 Claims, 5 Drawing Sheets

UNDERGROUND STRUCTURAL WORK INCLUDING PREFABRICATED ELEMENTS ASSOCIATED WITH PILES AND A PROCESS FOR ITS PRODUCTION

BACKGROUND OF THE INVENTION

The present invention relates in general to prefabricated reinforced concrete elements, whether precompressed or not, for the construction of works sunk beneath ground level such as artificial tunnels, underpasses, underground carparks and the like.

The majority of such works can be constructed only after open air excavations, and after having gone down to the level of the foundation or the floor of the work itself. Once the construction has been completed this must be covered over with earth in such a way as to form the embankment over the roof or the deck slab over the work and to sustain the supporting uprights at their flanks.

In many cases however the excavation cannot be performed in the conventional open air manner down to the base of the structure due to the lack of space for the banks at the sides thereof or else because the excavation involves risks for the stability of nearby works; in other cases the conventional excavation, with lateral banks is not economically convenient due to the large volume of ground to be excavated.

In order to avoid the formation of banks in the abovementioned cases the sides of the excavation can be supported by means of containment structures known per se such as bentonitic diaphragms, piling, tieback pile walls, sheet piling or the like. Some of such containment structures, such as sheet piling or tieback pile walls, are used in a temporary manner only to permit the excavation to proceed, while the sides of the work to be produced, for example the walls of a tunnel or the shoulders of an underpass, are usually constructed working close to the temporary containment structure.

If it is intended to form the sides of a tunnel, the shoulder of an underpass or the wall of an underground carpark in situ, these can be constituted by bentonite diaphragms or by piling with large diameter piles. In these cases the prefabricated structure is constituted in practice only by the deck and by possible intermediate floors. The deck between two bentonite diaphragms or between two series of large diameter piles is in general formed by prefabricated rectilinear beams of precompressed reinforced concrete laid on a beam made in situ on each piling header or diaphragm header. The prefabricated deck beams are then integrated in situ by means of concrete castings which complete the cover between one beam and the next and which makes it possible to considerably improve the robustness of the individual prefabricated beams.

This arrangement, currently very widely used, has however several disadvantages. In the first place the prefabricated deck beams are not normally assigned the task of transmitting from one piling header to the next the horizontal force necessary to resist the thrust of the ground which acts on each piling so that the piling must be dimensioned in such a way as to resist these thrusts themselves.

Moreover, if the deck beams should be rigidly fixed between the two piling headers, the expansion of these beams due to thermal variations would impose on the piling headers themselves deformations which could involve excessive stresses in the pile because of the limited deformability of the ground in contact with the pilings. To overcome this problem the piling headers are fixed by anchoring them to the ground via anchors, or tie rods of precompressed reinforced concrete and often between the deck beams and the piling headers there is introduced an expansion joint which allows the effects of thermal expansion of the deck beams to be absorbed. This arrangement however weakens the hermetic seal of the work in correspondence with the roof and the deck of a road possibly overlying the work.

In the second place, the deck beams are frequently of large dimensions, which causes significant problems for their transport, because they must be simply supported both so as not to form a rigid tie with the piling headers and for constructional convenience. Because of this type of fixing between these beams and the piling headers it is not possible to take advantage of the benefits due to the embedded bending moment at the supports of the beams so that these must be dimensioned also taking this disadvantage into account.

SUMMARY OF THE INVENTION

In the structure according to the invention the deck is of much reduced thickness in that it is possible to benefit from the advantageous effect due to the embedded bending moments at the lateral ends of the deck beams; which results in a considerable reduction in the mid point bending moment. Notwithstanding the reduction in the thickness, the rigidity of the deck against vertical loads is considerably increased thanks to the embedding at the ends so that the maximum deflection of the deck under load is reduced notwithstanding the reduction in the thickness of the elements of which it is composed.

The transport of the prefabricated elements is much simplified in that the length of the longest element, generally the central portion of the deck, is equal to about 60% of the clear span instead of about 110% of the span as occurred with conventional deck beams. In practice, all the prefabricated elements can be transported by road without exceeding the shape-limit imposed by road regulations (transport regulations) to permit the construction of works with spans up to about 25 m, whilst the dimensions of conventional prefabricated beams which can be transported by road allow maximum spans of only about 12–13 m to be achieved.

According to a preferred characteristic of the invention, the lateral portions of each deck section have a substantially L-shape form with an inclined intermediate part.

The presence of these inclined parts, which permits points of negative bending moment of the deck to be eliminated, further reduces the thickness of the deck itself.

The installation of the elements which constitute each section of the deck of the construction, which form an articulated quadrilateral which is balanced but unstable before being fixed in situ with the ridigifying castings, is very much facilitated by the presence of the bodies of concrete which constitute bracing members for the deck during its assembly.

Preferably there are provided adjustable means for varying the attitude of the said side portions, interposed between these portions and the pile-like elements, to allow balancing of these portions during assembly of the deck of the work.

In this way, during assembly of the deck its L-shape side portions are fixed with respect to the adjacent concrete bodies thanks to these adjustment means, preferably constituted by sscrews engaging respective nuts incorporated in the prefabricated elements, in such a way as to prevent an articulated quadrilateral from leaning, without it being necessary to utilise underpinning flasework to support the deck during its assembly.

If an intermediate slab is present, typical of underground carparks, it can be made as a prefabricaated element to be fixed to the structure close to the walls of the work with connections which guarantee the total reliability of its connection with the structure. The certainty of the embedded bending moment permits a further considerable reductin in the thickness. In any case the speed of construction of the entire work is much increased.

The invention further has for its subject a process for the construction of underground structures, particularly for tunnels, underpasses, underground carparks or the like, as well as a prefabricated element for such a structure.

DE-A-4 302 980 discloses a prefabricated element for a containment structure having an elongate reinforcement and a concrete body anchored to an upper end of the reinforcement and facing the deck. The reinforcement body is axially aligned with respect to the reinforcement. The prefabricated element is inserted in a bore hole and concrete is cast in the lower part of the hole such as to anchor the element in the ground and to form in situ a pile element forming part of the containment structure.

BRIEF DESCRIPTION OF THE DRAWINGS

Further characteristics and advantages of the present invention will be better understood in the light of the following detailed description, given with reference to the attached drawings, provided purely by way of non-limitative example, in which.

DETAILED DESCRIPTION OF THE INVENTION

Figure 1:
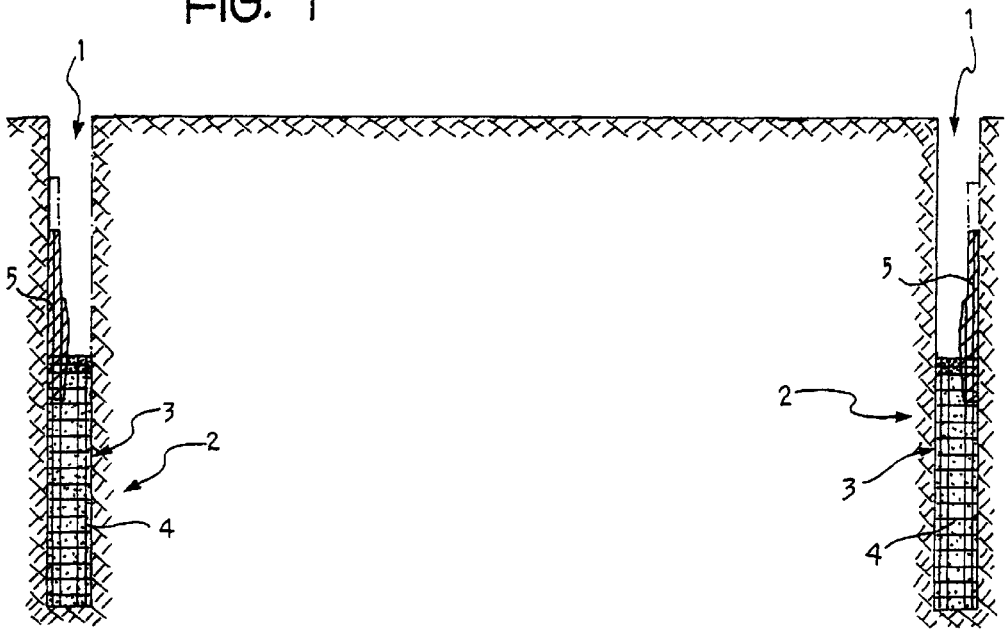
FIGS. 1 and 2 are front elevation views of cross-sections which illustrate successive phases in the execution of an excavation for producing an underground work.

With reference to the drawings, the reference numeral 1 indicates vertical bore holes of large diameter formed in two parallel aligned series of holes in the ground in correspondence with the sides of an underground work which it is intended to construct, for example an underpass or an underground carpark for the purpose of providing a pair of containment structures 2. Each of the holes 1 is intended to receive a containment pile formed in a manner which will be explained hereinafter.

Notwithstanding that the description will make specific reference to the containment structures made with large diameter piles, called "piling", the invention also applies in the case in which these structures are constituted by bentonite diaphragms.

In at least some of the holes 1, and preferably in all these holes, are inserted respective prefabricated supporting elements 3 in such a way as to extend down for several meters from the mouth of the bore, or a little below the mouth. Each element 3 comprises an elongate reinforcement 4 and an elongate body 5 of concrete anchored to the reinforcement 4 at its end intended to face upwardly, in such a way that a part of it projects axially from the reinforcement. The reinforcement 4 includes, in a manner known per se, a plurality of rectilinear rods 3*a* substantially distributed around a circumference, and a rod 3*b* wound in a helix about the rectilinear rods and fixed to them. The body 5 of concrete has a non-uniform substantially D-shape section the convex part of which is intended to face towards the outside of the excavation, that is to say towards the ground and in contact with it. The body 5 is dimensioned in such a way as to be able to support, once inserted in the pile, the thrust of the ground which acts irregularly on the pile. The body 5 is conveniently reinforced by several reinforcing rods of the reinforcement 4 to which it is connected, which are disposed close to the convex ground-contacting wall. A reinforcing rod 3*c* bent into a U extends from an axial cavity of the body 5 on the side opposite the reinforcement 4.

Having introduced the elements 3 into the holes 1 concrete is injected into each of them in such a way as to fill the interior space of the reinforcement 4 so as to form in situ a plurality of piles which include a respective prefabricated element 3. The concrete injection is limited to the deepest part of the hole so as to incorporate only the lower section of each body 5 in such a way that it is fixed, rigidly embedded in the pile. The upper part of each hole 1 is filled with sand, gravel or similar disposable material in such a way as to occupy both the peripheral space between the body 5 and the ground and the possible upper part of the bore which remains empty.

Figure 2:
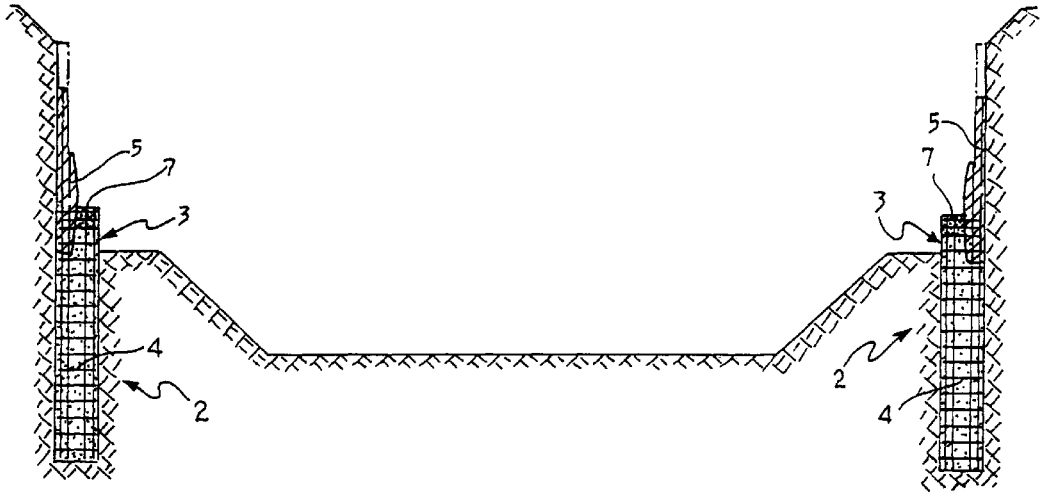
Figure 4:
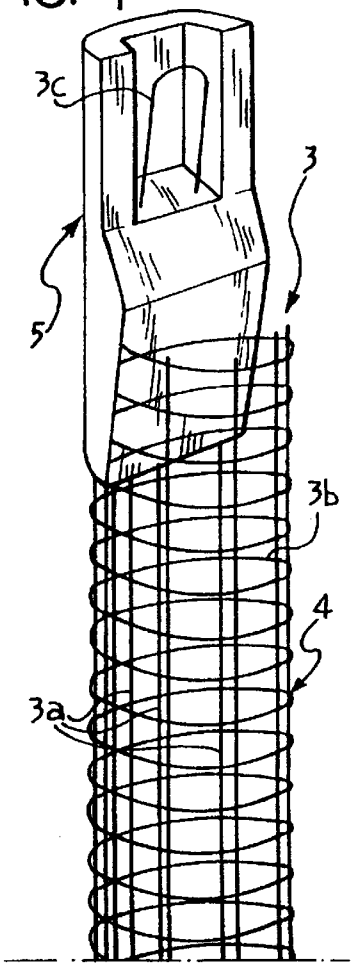
FIG. 4 is a perspective view of a prefabricated insert element of the piles of the lateral containment structure of the excavation.

Having formed the two lateral series of piles these constitute a pair of ground-containment structures 2 which allow the excavation in the zone defined between them to take place. Initially the excavation exposes the upper ends of the piles in such a way that the tops of the bodies 5 emerge from the ground (see FIG. 2). In this phase the bodies 5 inserted into the piles perform the function of a support wall (discontinuous in the case of the piling, almost continuous in the case of bentonite diaphragms). The sand or gravel which fills the upper parts of the bores is taken away together with the excavated material.

Figure 3:
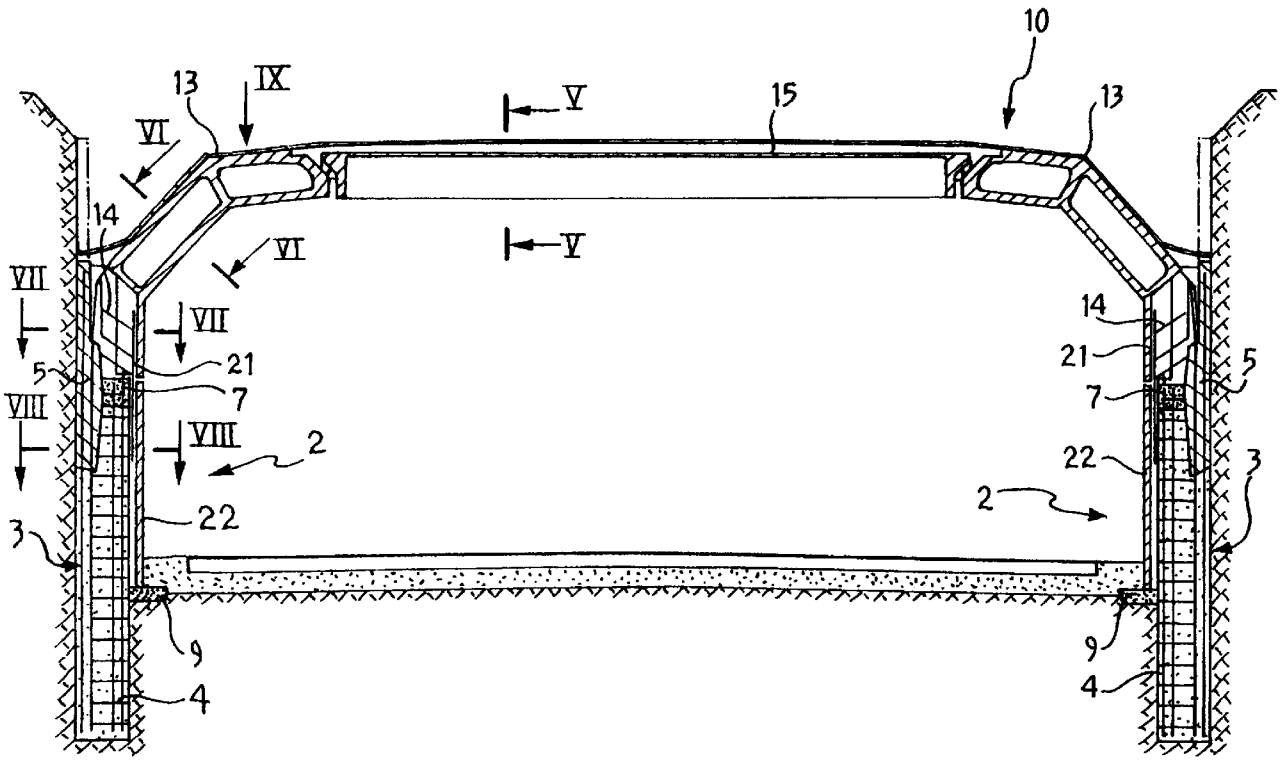
FIG. 3 is a view similar to FIGS. 1 and 2, of an artificial tunnel or underpass according to the invention.
Figure 5:
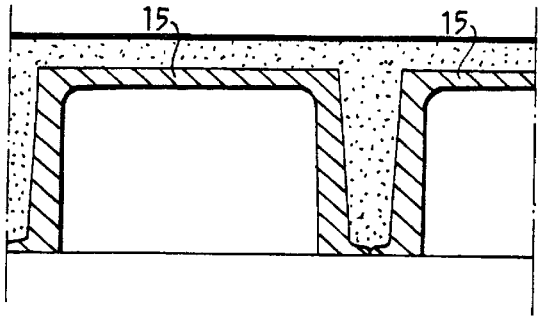
FIGS. 5 to 8 are sectioned elevations of details respectively corresponding to the lines V—V, VI—VI, VII—VII and VIII—VIII of FIG. 3, FIGS. 9 and 10 are views similar to FIG. 3 which represent successive phases in the construction of an underground carpark according to the invention.
Figure 6:
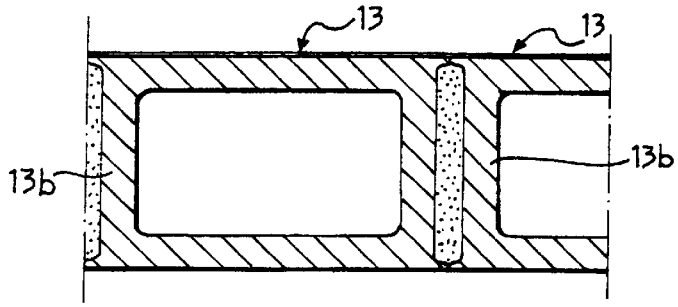
Figure 7:
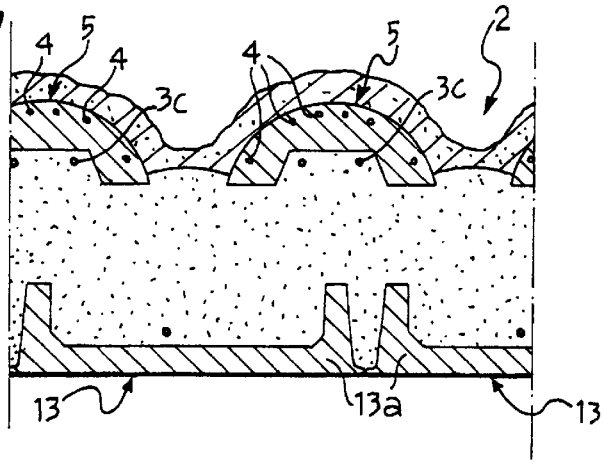
Figure 8:
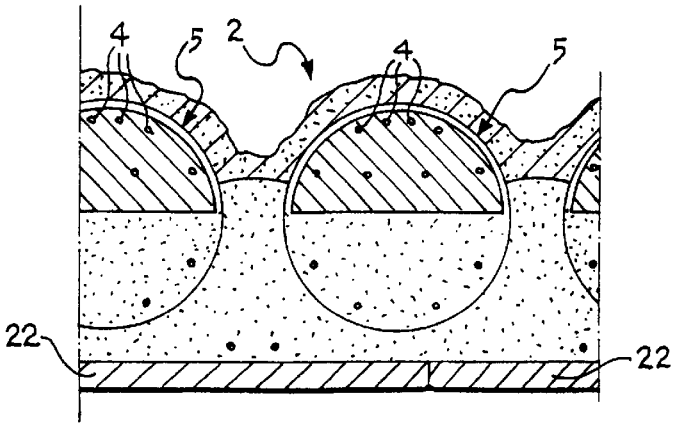
Figure 9:
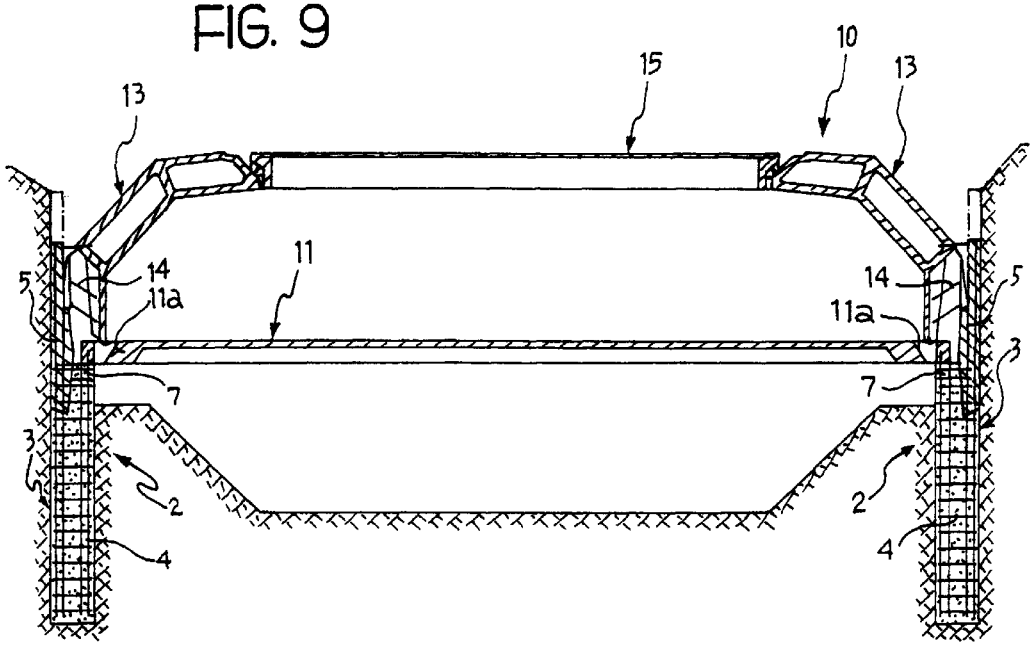
Figure 10:
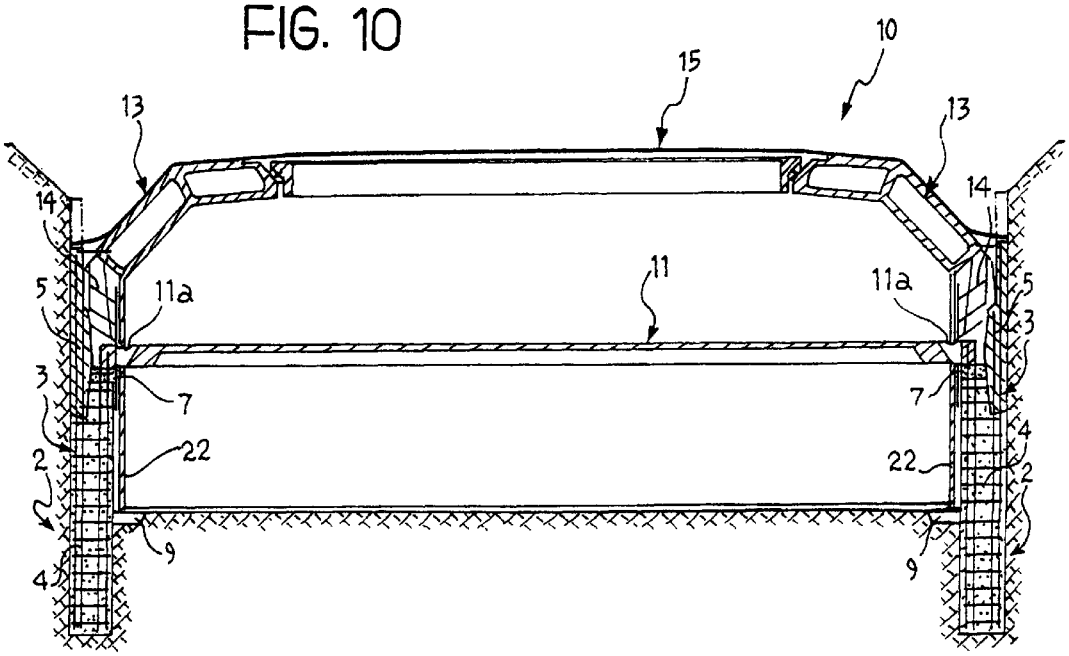
Figure 11:
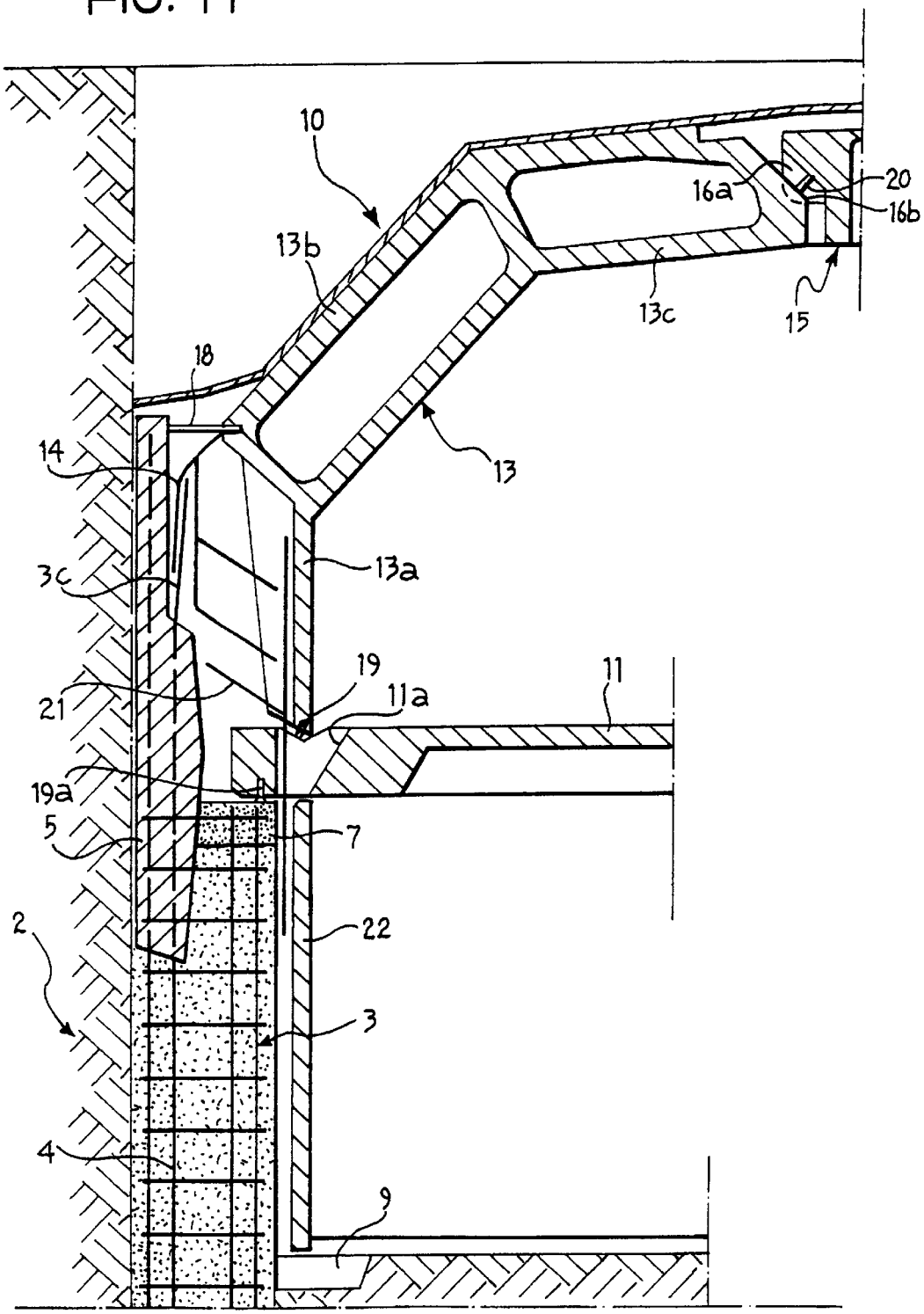
FIG. 11 is a view on an enlarged scale of a detail indicated with the arrow IX in FIG. 10.

Then, a pair of header beams or girders 7 of concrete are cast in such a way that each of these connects the upper ends of the piles of a respective row of piles. These beams have the purpose of defining a precise plane on which the slab or deck 10 of the work can be laid in the case of underpasses or tunnels (FIG. 3), or an intermediate slab 11 at the edges of which the deck 10 is to be carried in the case of underground carparks (FIGS. 9 to 11).

Then the excavation can continue down to the base of the work to be formed, where concrete foundation girders 9 are cast.

The deck 10 is formed of substantially vault-shape sections in succession alongside one another along the axial extent of the work and each section comprises three prefabricated elements assembled together, in particular a pair of side portions 13 each supported on a respective header beam 7, and a central substantially rectilinear portion 15 interposed between two respective side portions 13.

Conveniently, each side portion 13 is of inverted L-shape with the intermediate part beveled. Each side portion 13 is constituted by three rectilinear parts fixed together rigidly: a pier 13*a*, a beam 13*b* and a beam 13*c*. The pier 13*a* has an open U-shape section with a pair of ribs directed towards the embankment, the front disposed on a substantially vertical plane parallel to the axis of the work and reinforcing rods 14 projecting between the ribs and intended to engage a seat defined between the U-shape rod 3*c* of a body 5 and the body 5 itself. The configuration of the pier is such as to define between it and an adjacent body 5, in the assembled condition, a free space for casting concrete for rigidly connecting these elements together.

The beam 13*b*, which constitutes the bevel of the L has a closed section and is intended to be disposed in an inclined position, and the beam 13*c* also has a closed section and is intended to be disposed almost horizontally so as to be connected rigidly to the central portion 15.

Both the side portions 13 can be produced already in the form which it will assume once positioned or it can be constituted by articulated prefabricated parts, that is to say by sets of prefabricated elements of reinforced concrete connected by means of articulations between one element and another constituted by the same reinforcing rods, formed in the flat-rectilinear condition and bent at the moment of their installation, for example according to the teaching of European Patent EP-0 219 501.

The central portion 15 is an elongate beam which can be made of prestressed reinforced concrete. It has terminal projections 16*a* in the form of a nose which extends from the central part of its smaller sides, which can be received in seats 16*b* formed at the corresponding ends of the lateral portions 13.

To assemble a deck section 10 a side portion 13 is initially positioned on each beam cap 7, or on the ends of the intermediate slab 11 if this is present, in such a way that the rods 14 engage a steel rod 3*c* of a body 5, leaving spaces free between the portions 13 and the piles. The element 13 is temporarily supported close to its inner end by a vertical support of adjustable extent, not indicated in the drawings. In particular, the heads of pairs of screws 19 rest on one of the beams 7. If the intermediate slab 11 is present, the head of a pair of screws 19 of the same portion 13 rest on one end of the slab 11 and the slab itself is carried on the beams 7 by means of similar adjustable screws 19*a*.

Subsequently the central portion 15 is inserted between a pair of portions 13 in such a way that its projections 16*a* engage respectively in the seats 16*b* of the side portions, again leaving free spaces between the portions 13 and the portion 15. Adjustment screws 20, disposed in pairs close to each projection 16*a*, on the opposite sides with respect thereto, permit the attitude of each central portion 15 relative to the lateral portions 13 to be balanced in such a way as to render each deck section rigid overall and in stable equilibrium. Instead of the screws 20 rods projecting from the ends of the portion 15 can be utilised with corresponding rods extending from one end of both portions 13, intended to be welded together. At this point the height of the temporary supports for the elements 13 is reduced in such a way that these turn about the heads of the screws 19 until the projections 16*a* of the central portion 15 come into contact with the (substantially vertical) bottom walls of the seats 16*b*. In these conditions the structure constitutes a balanced but unstable articulated quadrilateral the central portion 15 of which is the link. The assembly is rendered stable by adjusting the extension of the pairs of horizontal screws 18 and the substantially vertical screws 19 which engage in respective bushes embedded in the concrete of the associated portion. The heads of the pairs of screws 18 rest directly on the face of one of the bodies 5 facing the interior of the structure.

In a constructional variant, between the portion 15 and the two adjacent portions 13 can be formed respective static hinges for example constituted by a layer of neoprene or other suitable material interposed between these elements during assembly.

The reinforcement of the entire structure is already partly inserted in the various prefabricated elements during their production and in part introduced between one prefabricated element and the other. For example auxiliary rods 21 can be advantageously utilised whenever necessary to guarantee a good connection between the piles of the containment structure 2 and the deck 10. These are in part interposed between the piles and the side portions 13 and in part extend along the piles themselves.

When the portions of a deck section 10 have been thus assembled they are rendered rigid with cast concrete injected in such a way as to fill the free spaces left between one element and the other, incorporating the reinforcing rods present in these spaces. To contain the fresh cast concrete the various portions are provided with a longitudinal projection on all the corners facing towards the internal face of the structure.

The work is then completed with the casting of the lower part of the inner wall of the work against the piles. To perform this operation it is sometimes useful to employ wall panels 22 serving as disposable shuttering.

In the case of underground carparks the operation of this concrete casting is facilitated by a pair of conical apertures 11*a* formed close to the ends of the prefabricated elements of the intermediate slab 11, operable to form funnels for the passage of the fresh concrete and to allow the insertion of the rods 21 through them. The upper parts of these rods 21 are then incorporated in the casting formed between a beam 7, a pier 13*a* and an associated body 5, with their lower part in the casting formed between the piles of the adjacent containment structure 2, the associated panels 22 and the intermediate slab 11.

With the arrangement of the present invention it is possible to achieve an excellent degree of integration between the large diameter piles of the containment structure 2 and the deck 10 of the structure. The concrete castings performed in situ between the bodies 5 inserted in the piles and the piers 13*a* of the lateral portions 13 of the deck 10 form junctions able easily to transmit the flexing and shear forces by the reinforcements which project from the various prefabricated elements and which are incorporated in the castings.

The concrete body 5 inserted in the piles of the containment structure 2 has initially the function of a supporting wall portion to resist the thrust of the ground during the excavation works and assembly of the deck 10, whilst in the finished work they have assigned to them the function of encouraging the monolithic connection between the piles and the cover 10, which is subject to considerable stresses.

The integration of the lateral portions 13 and the central portion 15 of the deck 10 is obtained by means of the continuity of the lower reinforcement incorporated in the castings between adjacent prefabricated elements and by means of the upper reinforcements incorporated in the casting of the cooperating slab.

The deck 10 of the work thus constructed is very well able to transmit between one header beam 7 and the other the horizontal forces which resist the thrust of the ground on each of the lateral containment structures 2, being formed in such a way as to be fixed rigidly to the header beams 7 notwithstanding that no reinforcements project from these which would make it difficult to bring the prefabricated elements into position.

There is moreover obtained the advantage that the deck 10, due to the presence of a change in level between its central portion and the connection regions with the walls of the structure, does not constitute a tie too rigid between the lateral containment structures 2. With a suitable dimensioning there is easily obtained a rigidity compatible both with the thermal variations of the cover and with the transmission of the thrust of the ground between the two containment structures 2. Thanks to the bevels of the lateral portions 13 the transmission of this thrust induces in the deck 10 flexural stresses of opposite sign from those induced by the weights and by the loads which act on it, reducing the dimensions and encouraging the flexibility thereof. In general, for correct dimensioning it is necessary that the upper level of the casting formed in correspondence with the lateral containment structures 2 be at a lower height than the upper point of the intrados of the deck.

What is claimed is:

1. An underground structural work comprising a pair of containment structures (2) which extend along opposite sides of the work and include elements in the form of piles adapted to bear the thrust of the ground during excavation and construction of the work, said elements supporting a deck (10) formed by prefabricated deck sections extending between the containment structures (2), wherein each of said piles comprises a prefabricated bearing element (3) which includes elongate reinforcement members (4) and a concrete body (5) anchored to the reinforcement members within said bearing element with one end of the concrete body extending beyond the reinforcement members, the concrete body (5) being arranged in axial misalignment with respect to the reinforcement members (4) to define a side space above the reinforcement members (4) adjacent one side of the concrete body (5), each bearing element (3) being arranged so that the concrete body (5) is adjacent the ground toward the outside of the excavation so that the side space faces the excavation, and wherein each deck section is shaped substantially as a vault and includes a plurality of prefabricated concrete elements (13, 15) with the ends of each deck section **(13*a*) being disposed adjacent said concrete bodies (5) in said side spaces, said ends (13*a*) of the deck section and said concrete bodies (5)** being spaced to define free spaces filled with concrete for anchoring the ends of the deck section and the concrete bodies together.

2. An underground structural work according to claim 1, wherein the plurality of prefabricated concrete elements define a central portion (15) and a pair of side portions (13), each side portion (13) being positionable between the central portion (15) and one of the containment structures (2).

3. An underground structural work according to claim 2, characterised in that the side portions (13) of each deck section have a generally L-shape form with an intermediate beveled part.

4. An underground structural work according to claim 2, characterised in that between the central portion (15) and the associated side portions (13) of each deck section concrete is cast in situ in such a way as to rigidly connect these portions together.

5. An underground structural work according to claim 2, characterised in that both the concrete bodies (5) and the ends **(13*a*) of the side portions (13) intended to be disposed adjacent the concrete bodies (5) have reinforcing steel rods (3*c*, 14) projecting into an associated free space, which are intended to be incorporated into the concrete cast in situ for the purpose of rigidly connecting the lateral portions (13) to the said piles to encourage the transmission of stresses between the containment structure (2) and the deck of the work (10)**.

6. An underground structural work according to claim 2, characterised in that the free space for casting concrete in situ between the concrete bodies (5) and the side portions (13) is entirety disposed at a lower height than the intrados at the middle of the deck (10) of the work.

7. An underground structural work according to claim 2, wherein adjustable screw means (18, 19) for varying the attitude of the said side portions (13) are interposed between the side portions (13) of each deck section and the respective piles to permit balancing the side portions (13) during assembly of the deck (10) of the work.

8. An underground structural work according to claim 2, characterised in that the work includes an intermediate slab (11) the ends of which are supported in correspondence with header beams (7) of the said containment structure (2) and support the deck (10) of the work, in which the said concrete castings are intended to rigidly connect the side portions (13) with one end of the slab (11) and the associated containment structure (2).

9. An underground structural work according to claim 8, characterised in that, in correspondence with the ends of the slab (11) there are formed respective conical apertures **(11*a*) able to define passages for the concrete castings and for allowing the insertion of auxiliary reinforcing rods (21)** through them.

10. An underground structural work as set forth in claim 1, characterised in that each of the elongate reinforcement members (4) includes a plurality of rectilinear rods **(3*a*) substantially distributed around a circumference and a rod (3*b*) helically wound around the rectilinear rods (3*a*) and fixed to them, the concrete body (5) having an elongate form with substantially D-shape section with a part projecting from an end of the reinforcement members (4), there being provided a rod (3*c*) bent into a U which extends from the concrete body (5) in the direction away from the reinforcement members (4)**.

11. A process for the production of underground works, particularly for tunnels, underpasses, carparks, characterised in that it comprises, in combination, the following operations:

forming a plurality of holes (1) in the ground in two sets aligned along the sides of the work to be undertaken, inserting into at least some of these holes (1) a respective prefabricated element (3) comprising an elongate reinforcement (4) and a concrete body (5) anchored to an upper end of the reinforcement (4), the concrete body (5) being, at least in correspondence of its end opposite to the elongate reinforcement (4), arranged axially misaligned with respect to the reinforcement (4) in order that a side space is defined above the reinforcement and sideways with respect to the concrete body (5), the inserting of each concrete body (5) being carried out so that each concrete body (5) is arranged adjacent to the ground towards the outside of the excavation, casting concrete in the said holes (1) to form in situ a plurality of pile-like elements which incorporate the said reinforcement (4) and part of the said concrete body (5), filling the upper parts of the holes (1) substantially up to the level of the ground with sand or gravel or similar disposable material, so that said side spaces are filled with the disposable material, excavating between the piles formed in the two aligned set of holes (1), taking away the disposable material from said side spaces, forming a header beam (7) in correspondence with each set of piles, connected to the upper ends of the said reinforcements (4), disposing on the header beams (7) a deck (10) of the work, formed in sections each of which comprises a pair of side portions (13) each resting on a respective header beam (7), and a central portion (15) supported by the side portions (13), free spaces being formed between the side portions (13) of the deck (10) and the concrete bodies (5) of the said pile elements in correspondence of said side spaces of the prefabricated elements (3), casting concrete into the said free spaces in such a way as to rigidly connect the side portion (13) with at least an associated pile element.

12. A process according to claim 11, in which the work includes an intermediate slab (11), characterised in that after formation of said header beams (7), including the step of laying the slab (11) on the header beams, and disposing the deck sections of the work on the longitudinal ends of the slab (11).

* * * * *